US009395682B2

(12) United States Patent
Chonabayashi et al.

(10) Patent No.: US 9,395,682 B2
(45) Date of Patent: Jul. 19, 2016

(54) ACCOMMODATING CONTAINER, AND RECORDING MATERIAL SUPPLY APPARATUS

(71) Applicant: FUJI XEROX CO., LTD., Tokyo (JP)

(72) Inventors: Yuya Chonabayashi, Kanagawa (JP); Hiroyuki Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/504,695

(22) Filed: Oct. 2, 2014

(65) Prior Publication Data

US 2015/0277357 A1 Oct. 1, 2015

(30) Foreign Application Priority Data

Mar. 25, 2014 (JP) ..... 2014-062503

(51) Int. Cl.
*G03G 15/00* (2006.01)
*G03G 21/16* (2006.01)

(52) U.S. Cl.
CPC ..... *G03G 21/1661* (2013.01); *G03G 15/6505* (2013.01); *G03G 2215/00383* (2013.01); *G03G 2221/1684* (2013.01)

(58) Field of Classification Search
CPC ..... G03G 21/1614; G03G 21/1661; G03G 21/1839; G03G 21/1846; G03G 2221/1846; G03G 15/6502; G03G 2215/00383
See application file for complete search history.

(56) References Cited

U.S. PATENT DOCUMENTS

| | | | | | |
|---|---|---|---|---|---|
| D205,888 | S | * | 10/1966 | Clayton | D8/317 |
| 3,330,555 | A | * | 7/1967 | Shearer et al. | 271/30.1 |
| D219,330 | S | * | 12/1970 | McCain et al. | D8/350 |
| D231,322 | S | * | 4/1974 | James | D8/319 |
| D252,183 | S | * | 6/1979 | DeWindt | D8/300 |
| 4,908,661 | A | * | 3/1990 | Iwata | G03G 15/751 399/116 |
| 5,287,145 | A | * | 2/1994 | Ohtsuka | 399/100 |
| D352,441 | S | * | 11/1994 | Oury et al. | D8/303 |
| D362,169 | S | * | 9/1995 | Caugh et al. | D8/317 |
| D423,904 | S | * | 5/2000 | Caugh et al. | D8/317 |
| D646,551 | S | * | 10/2011 | Owens | D8/317 |
| D661,973 | S | * | 6/2012 | Han | D8/317 |
| D662,389 | S | * | 6/2012 | Hauber | D8/319 |
| 2004/0037587 | A1 | * | 2/2004 | Yamaguchi et al. | 399/119 |
| 2004/0234293 | A1 | * | 11/2004 | Karakama et al. | 399/111 |
| 2009/0180802 | A1 | * | 7/2009 | Sato et al. | 399/119 |
| 2011/0274462 | A1 | * | 11/2011 | Kim et al. | 399/119 |
| 2012/0328328 | A1 | * | 12/2012 | Okabe | 399/116 |
| 2014/0294439 | A1 | * | 10/2014 | Kawahara | G03G 21/1623 399/119 |

FOREIGN PATENT DOCUMENTS

JP A-2007-297153 11/2007

* cited by examiner

*Primary Examiner* — David Gray
*Assistant Examiner* — Sevan A Aydin
(74) *Attorney, Agent, or Firm* — Oliff PLC

(57) ABSTRACT

Provided is an accommodating container that is mounted in a housing, accommodates an accommodated object therein, and is provided in such a manner that the accommodating container is capable to be pulled out of the housing, the accommodating container including an operation reception portion that is provided with a starting point in a portion thereof which a user touches when pulling the accommodating container out of the housing, and plural ridge portions which extend in different directions from the starting point.

6 Claims, 11 Drawing Sheets

ACCOMMODATING CONTAINER, AND RECORDING MATERIAL SUPPLY APPARATUS

CROSS-REFERENCE TO RELATED APPLICATIONS

This application is based on and claims priority under 35 USC 119 from Japanese Patent Application No. 2014-062503 filed Mar. 25, 2014.

BACKGROUND

Technical Field

The present invention relates to an accommodating container, and a recording material supply apparatus.

SUMMARY

According to an aspect of the invention, there is provided an accommodating container that is mounted in a housing, accommodates an accommodated object therein, and is provided in such a manner that the accommodating container is capable to be pulled out of the housing, the accommodating container including:

an operation reception portion that is provided with a starting point in a portion thereof which a user touches when pulling the accommodating container out of the housing, and plural ridge portions which extend in different directions from the starting point.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described in detail with reference to the accompanying drawings.

Description of Copy Machine

Figure 1:
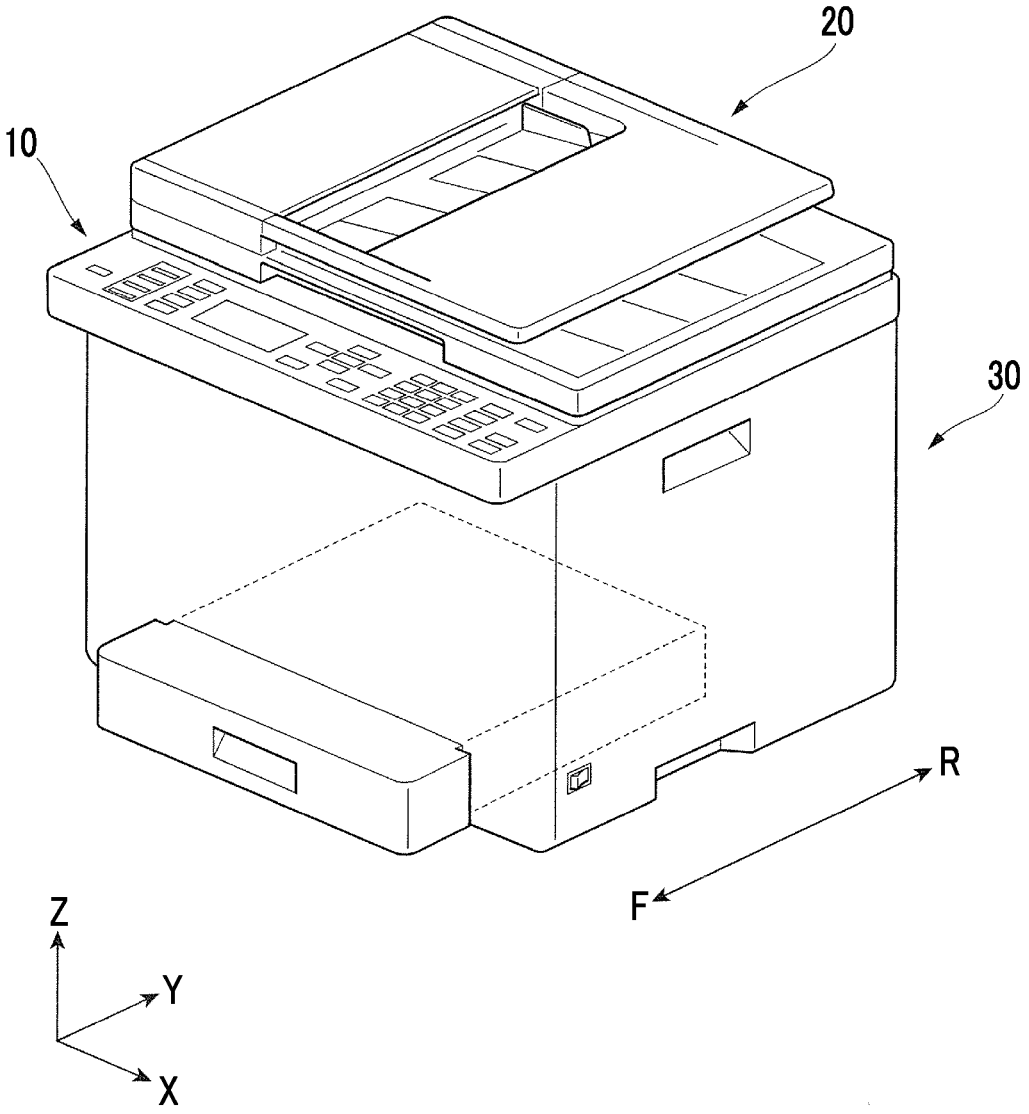
FIG. 1 is a view illustrating an example of the entire configuration of a copy machine of an exemplary embodiment.

FIG. 1 is a view illustrating the entire configuration of a copy machine 1 to which the exemplary embodiment is applied, and is a perspective view of the copy machine 1 that receives a user's instruction or operation from a front F side, when seen from the front F side.

For example, the copy machine 1 includes an image forming apparatus 30 that forms an image by using electrophotography; an image reader 20 that is disposed above the image forming apparatus 30, and optically reads the image of the original document; and an instruction reception apparatus 10 that is attached to a front F side of the image reader 20, and receives various instructions from a user. In the copy machine 1, the image reader 20 reads the image of an original document based on a copy instruction received via the instruction reception apparatus 10, and the image forming apparatus 30 forms an image on a sheet as an example of a recording material based on the image data acquired by reading the image of the original document, thereby making a copy of the image.

The image forming apparatus 30 of the copy machine 1 also functions as a printer that forms an image on a sheet based on image data input from an external device such as a computer.

In the following description of the copy machine 1, a z direction refers to a direction from a lower portion to an upper portion of the copy machine 1, a y direction refers to a direction from the front F side to a rear R side, and an x direction refers to a direction that is orthogonal to the z direction and the y direction, and is oriented from the left to the right when the copy machine 1 is seen from the front F side.

Description of Image Forming Apparatus

Subsequently, the image forming apparatus 30 of the copy machine 1 will be described.

Figure 2:
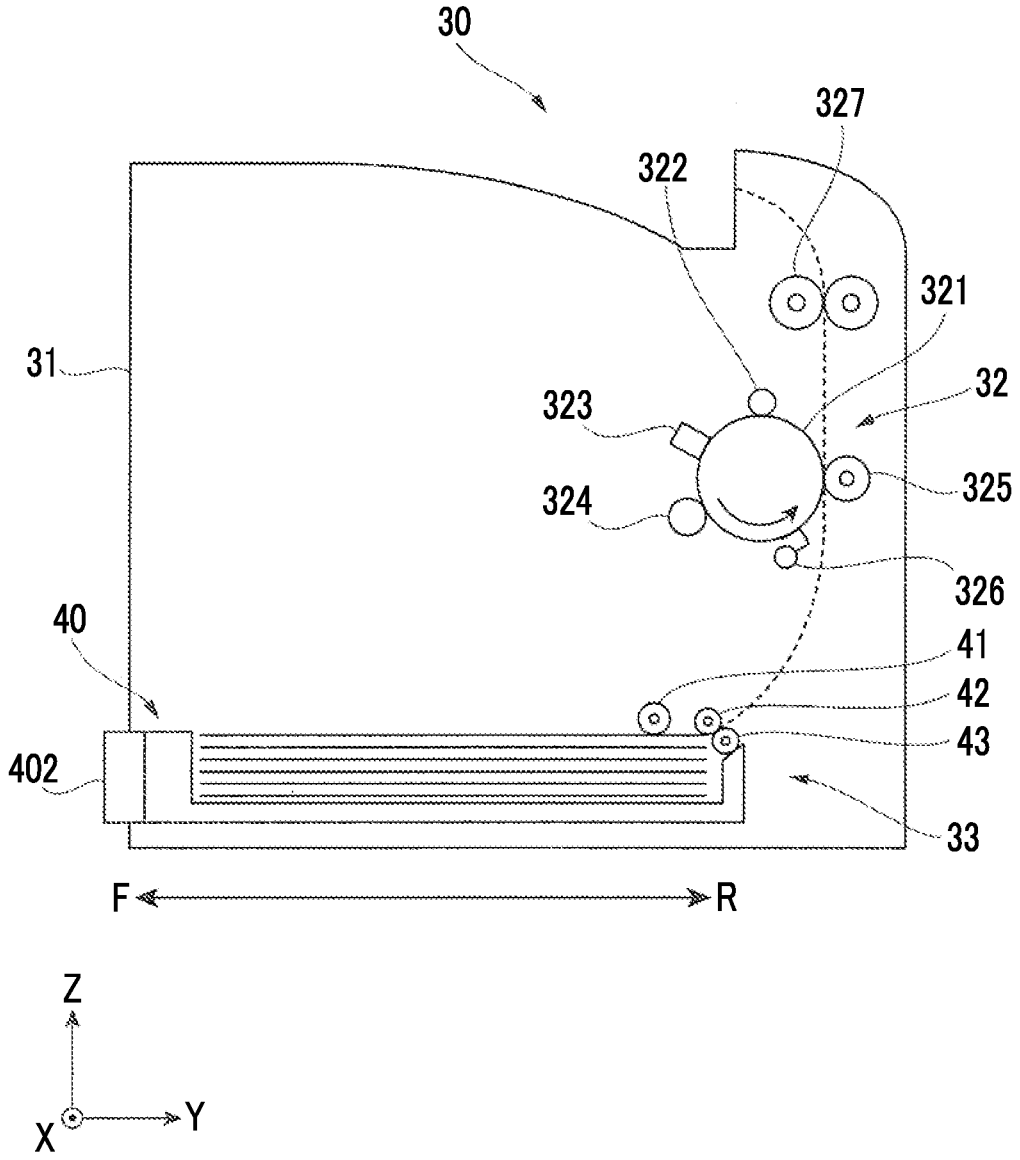
FIG. 2 is a cross-sectional view illustrating the configuration of an image forming apparatus.

FIG. 2 is a view illustrating the configuration of the image forming apparatus 30 of the copy machine 1, and is a y-z cross-sectional view.

The image forming apparatus 30 includes an image forming unit 32 that forms an image based on image data; a sheet supply unit 33 that is disposed below the image forming unit 32, and is an example of a recording material supply apparatus which supplies sheets to the image forming unit 32; and a housing 31 that is an example of an apparatus body which accommodates and holds the image forming unit 32 and the sheet supply unit 33 therein.

The image forming unit 32 includes a photosensitive drum 321; a charging unit 322; an exposure unit 323; a developing unit 324; a transfer roller 325; a drum cleaner 326; and a fixing unit 327. An image forming method used by the image forming unit 32 is not limited to the electrophotography, and an injection method or other methods may be used.

The sheet supply unit 33 includes an accommodating container 40 that is an example of a container which accommodates an accommodated object such as sheets therein; a sheet feeding roller 41 that is an example of a supply unit which supplies the sheets accommodated in the accommodating container 40 to the outside in association with the rotation of the sheet feeding roller 41; and a separation mechanism that separates the sheets supplied via the sheet feeding roller 41 one by one. The separation mechanism includes a feed roller 42 that is rotatably disposed, and a retard roller 43 that is in contact with the feed roller 42 and is rotatably disposed.

Description of Image Forming Operation of Image Forming Apparatus

Here, an image forming operation will be described in which an image is formed on a sheet accommodated in the accommodating container 40.

In the image forming unit 32, a toner image is formed on the photosensitive drum 321 via a step of charging the photosensitive drum 321 with the charging unit 322, a step of forming an electrostatic latent image on the photosensitive drum 321 by using scanning exposure light from the exposure unit 323, and a step of developing the electrostatic image formed on the photosensitive drum 321 with a toner by using the developing unit 324. The toner image formed on the photosensitive drum 321 is transported to a position in which the transfer roller 325 is disposed.

In contrast, the sheet supply unit 33 transmits sheets from the accommodating container 40 via the sheet feeding roller 41, based on a copy instruction received via the instruction reception apparatus 10. The separation mechanism transports the transmitted sheets one by one to the position in which the transfer roller 325 is disposed.

The sheet is supplied via the separation mechanism when the toner image on the photosensitive drum 321 is transported to the disposition position of the transfer roller 325. Accordingly, the toner image is electrostatically transferred onto the sheet due to the action of a transfer electric field formed on the transfer roller 325.

Thereafter, the sheet onto which the toner image is electrostatically transferred is separated from the photosensitive drum 321, and then transported to the fixing unit 327. The fixing unit 327 fixes the toner image on the sheet via a fixing process using heat and pressure, and thus an image is formed on the sheet. The sheet with the formed image is discharged from the image forming apparatus 30.

Description on Pushing Accommodating Container into and Pulling Accommodating Container Out of Housing In the exemplary embodiment, the accommodating container 40 of the sheet supply unit 33 is provided to be movable with respect to the housing 31 in the −y direction and the y direction. More specifically, the accommodating container 40 is set in a state (an accommodated state) of being typically accommodated inside the housing 31 of the image forming apparatus 30. In the accommodated state, the sheets may be supplied from the accommodating container 40 to the image forming unit 32. Even in the accommodated state, a partial portion (an operation reception portion 402 which will be described later) on a front F side of the accommodating container 40 remains exposed to the front F side more than the housing 31.

When the user moves the accommodating container 40 in the accommodated state in the −y direction with respect to the housing 31, the accommodated state transits to a state (a pull-out state) in which the accommodating container 40 is pulled out of the housing 31 of the image forming apparatus 30. In the pull-out state, the user may refill the accommodating container 40 with sheets. Even in the pull-out state, a partial portion on a rear R side of the accommodating container 40 remains inside the housing 31.

When the user moves the accommodating container 40 in the pull-out state in the y direction with respect to the housing 31, the state of the accommodating container 40 transits from the pull-out state to the accommodated state.

With regard to an operation (a pull-out operation) in which the accommodated state transits to the pull-out state, or an operation (a push-in operation) in which the pull-out state transits to the accommodated state, the user grasps the partial portion (the operation reception portion 402 which will be described later) of the accommodating container 40, the portion protruding toward the front F side further than the housing 31 with the accommodating container 40 being in the accommodated state, and the user pulls the accommodating container 40 to the −y direction or pushes the accommodating container 40 to the y direction with respect to the housing 31.

Here, the sheet feeding roller 41 and the feed roller 42, which are members of the sheet supply unit 33 along with the accommodating container 40, are attached to the housing 31, and the retard roller 43 is attached to the accommodating container 40. Accordingly, in the pull-out and push-in operations of the accommodating container 40, the retard roller 43 moves along with the accommodating container 40, but the sheet feeding roller 41 and the feed roller 42 do not move along with the accommodating container 40. The attachment location of the retard roller 43 is not limited to the accommodating container 40, and the retard roller 43 may be attached to the housing 31.

Description of Configuration of Accommodating Container

Figure 3:
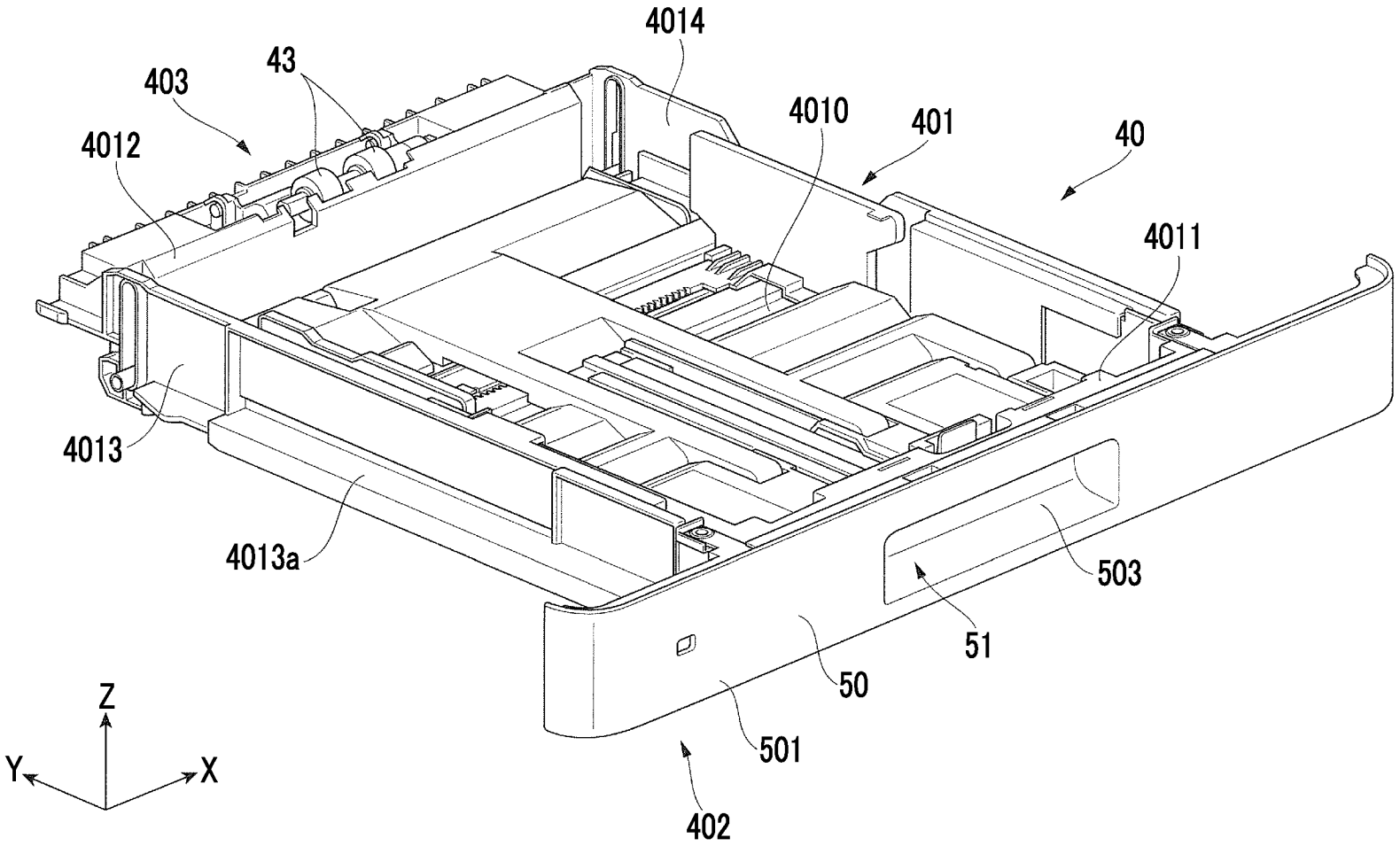
FIG. 3 is a perspective view illustrating the configuration of an accommodating container.

Subsequently, the configuration of the accommodating container 40 will be described. FIG. 3 is a view illustrating the configuration of the accommodating container 40, and a perspective view of the accommodating container 40 when seen from the front F side.

The accommodating container 40 has a container body portion 401 which accommodates an accommodated object such as sheets; the operation reception portion 402 which is attached to a front F side of the container body portion 401, and receives a pull-out operation and a push-in operation from the user; and a sheet feeding mechanism unit 403 which is attached to a rear R side of the container body portion 401, and on which the retard roller 43 is mounted.

The container body portion 401 has a rectangular parallelepiped shape, the upper portion of which is open. The container body portion 401 includes a bottom plate 4010 on which refilled sheets pile up; a front plate 4011 that extends along the z direction from an end portion on a front F side of the bottom plate 4010, and is an object to which the operation reception portion 402 is attached; and a rear plate 4012 that extends along the z direction from an end portion on a rear R side of the bottom plate 4010, and is an object to which the sheet feeding mechanism unit 403 is attached.

The container body portion 401 includes a left plate 4013 which extends along the z direction from a left end portion of the bottom plate 4010, and in which an end portion on a front F side of the left plate 4013 is connected to a left end portion of the front plate 4011, and an end portion on a rear R side of the left plate 4013 is connected to a left end portion of the rear plate 4012. In addition, the container body portion 401 includes a right plate 4014 which extends along the z direction from a right end portion of the bottom plate 4010, and in which an end portion on a front F side of the right plate 4014 is connected to a right end portion of the front plate 4011, and an end portion on a rear R side of the right plate 4014 is connected to a right end portion of the rear plate 4012.

A left rail 4013*a* is provided on an outwardly (leftwards) exposed left surface of the left plate 4013, and extends along the y direction. A right rail (not illustrated) is provided on an outwardly (rightwards) exposed right surface of the right plate 4014, and extends along the y direction.

Two rail guides (not illustrated) are provided inside the housing 31, and each of the rail guides extends in the y direction. The rail guides guide the accommodating container 40 in the y direction and the −y direction via the left rail 4013*a* and the right rail, respectively, when the user pushes in the accommodating container 40 and pulls out the accommodating container.

Description of Configuration of Operation Reception Portion

Subsequently, the configuration of the operation reception portion 402 of the accommodating container 40 will be described.

Figure 4:
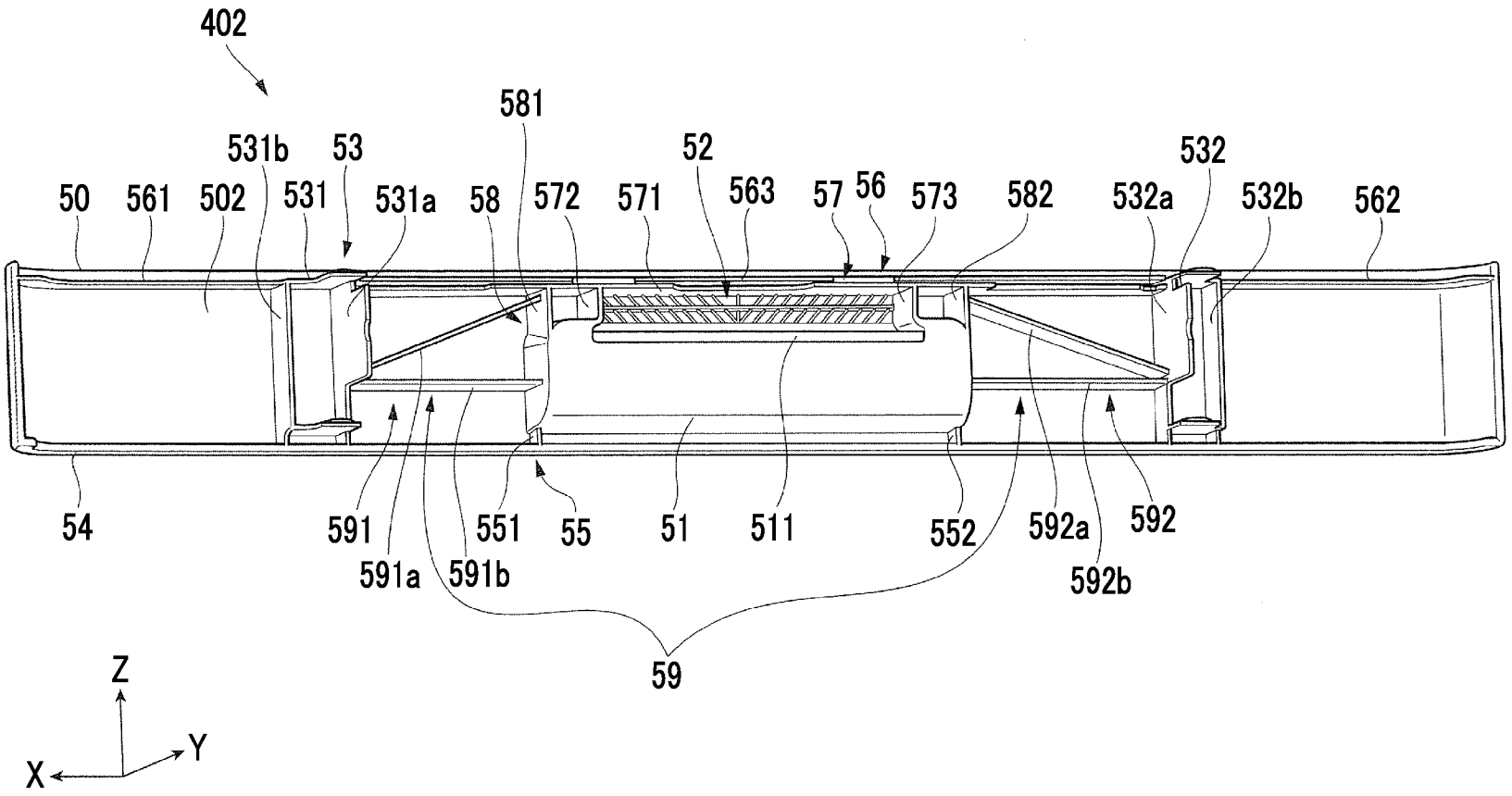
FIG. 4 is a perspective view illustrating the configuration of an operation reception portion when seen from the rear in FIG. 3.

FIG. 4 is a view illustrating the configuration of the operation reception portion 402 of the accommodating container 40, and is a perspective view of the operation reception portion 402 when seen from the rear R side.

Hereinafter, the configuration of the operation reception portion 402 will be described with reference to the perspective view when seen from the front F side illustrated in FIG. 3 and the perspective view when seen from the rear R side illustrated in FIG. 4.

The operation reception portion 402 includes a base portion 50 that is provided with a front surface portion 501 facing the front F side and a back surface portion 502 which lies on a back side of the front surface portion 501 and faces the rear R side. An opening portion 503 is provided at a part in a center portion of the operation reception portion 402 in the z direction and the x direction. The opening portion 503 is provided from the front surface portion 501 to the back surface portion 502 so as to extend in the z direction and extend in the x direction further than in the z direction. The base portion 50 extends in the z direction, and extends in the x direction further than in the z direction. Both end portions of the base portion 50 in the x direction are bent in the y direction.

In addition, the operation reception portion 402 includes a recess forming portion 51 that protrudes from the back surface portion 502 of the base portion 50 in the y direction; a rib portion 52; an attachment portion 53; a base-portion lower end portion 54; a base-portion lower end connecting portion 55; an attachment portion connecting portion 56; a rib-portion end portion 57; a recess forming-portion extending portion 58; and an auxiliary rib portion 59.

The recess forming portion 51 has a recessed shape that is open to the front F side, and includes another opening portion 511 provided in an upper surface thereof. The recess forming portion 51 is attached to the back surface portion 502 of the base portion 50 in such a manner that the opening portion 503 is covered with a front F side of the recess forming portion 51. A space continues from the opening portion 503 to the other opening portion 511 via an opening on the front F side of the recess forming portion 51.

The rib portion 52 includes plural ribs disposed in a region that lies along the x direction on an upper end of the opening portion 503 and on a front F side of the other opening portion 511 of the back surface portion 502. A center portion in the x direction of the other opening portion 511 overlaps a center portion in the x direction of a lower end portion of the rib portion 52 in the x direction and the z direction, and the center portions are adjacent to each other upstream in the y direction. The detailed description of the rib portion 52 will be given later.

The attachment portion 53 includes a first attachment portion 531 and a second attachment portion 532 which are provided while being respectively separated to the x direction and the −x direction from the recess forming portion 51 and the rib portion 52, and each of which has a rectangular parallelepiped shape that is open to the rear R side. The first attachment portion 531 and the second attachment portion 532 are disposed to interpose the recess forming portion 51 and the rib portion 52 therebetween.

The first attachment portion 531 of the attachment portion 53 is connected to an x direction end portion of the front plate 4011 of the container body portion 401, and the second attachment portion 532 is connected to a −x direction end portion of the front plate 4011. As a result, the operation reception portion 402 is attached to the container body portion 401. The first attachment portion 531 includes upper and lower end portions, a first-attachment first side surface 531*a* that is an end surface lying upstream in the x direction, a first-attachment second side surface 531*b* that is an end surface lying downstream in the x direction. The second attachment portion 532 includes upper and lower end portions, a second-attachment first side surface 532*a* that is an end surface lying downstream in the x direction, and a second-attachment second side surface 532*b* that is an end surface lying upstream in the x direction.

The base-portion lower end portion 54 is provided on the entire lower end of the back surface portion 502, and is connected to respective lower end portions of the first-attachment first side surface 531*a*, the first-attachment second side surface 531*b*, the second-attachment first side surface 532*a*, and the second-attachment second side surface 532*b*.

The base-portion lower end connecting portion 55 includes a first lower end connecting portion 551 and a second lower end connecting portion 552. The first lower end connecting portion 551 connects an x direction end portion of a lower surface of the recess forming portion 51 and the base-portion lower end portion 54. The second lower end connecting portion 552 connects a −x direction end portion of the lower surface of the recess forming portion 51 and the base-portion lower end portion 54.

The attachment portion connecting portion 56 includes a center connecting portion 563 that connects an upper end portion of the first-attachment first side surface 531*a* and an upper end portion of the second-attachment first side surface 532*a*. In addition, the attachment portion connecting portion 56 includes a first connecting portion 561 and a second connecting portion 562. The first connecting portion 561 extends to the x direction from an upper end portion of the first-attachment second side surface 531*b* to an x direction end portion of the back surface portion 502. The second connecting portion 562 extends to the −x direction from the second-attachment second side surface 532*b* to a −x direction end portion of the back surface portion 502.

The rib-portion end portion 57 is provided to surround the rib portion 52. The rib-portion end portion 57 is provided along an upper end portion of the rib portion 52, and includes a rib upper end portion 571 that connects the first-attachment first side surface 531*a* and the second-attachment first side surface 532*a*. The rib-portion end portion 57 includes a first rib end portion 572 and a second rib end portion 573 that are respectively provided in the x direction end portion of the rib portion 52 and the −x direction end portion of the rib portion 52, and that connect the rib upper end portion 571 and the upper surface of the recess forming portion 51.

The recess forming-portion extending portion 58 includes a first extending portion 581 that connects an end surface downstream of the recess forming portion 51 in the x direction and the rib upper end portion 571; and a second extending portion 582 that connects an end surface upstream of the recess forming portion 51 in the x direction and the rib upper end portion 571.

The auxiliary rib portion 59 includes a first auxiliary rib portion 591 and a second auxiliary rib portion 592 which are respectively provided between the first attachment portion 531 and the recess forming portion 51, and between the second attachment portion 532 and the recess forming portion 51.

The first auxiliary rib portion 591 includes a first inclined rib 591*a* that extends to the x direction from the first extending portion 581, and inclines to the −z direction so as to connect the first extending portion 581 and the first-attachment first side surface 531*a*. In addition, the first auxiliary rib portion 591 includes a first horizontal rib 591*b* that is positioned below the first inclined rib 591*a*, and that connects a right end surface downstream in the x direction of the recess forming portion 51 and the first-attachment first side surface 531*a*.

The second auxiliary rib portion 592 includes a second inclined rib 592*a* that extends from the second extending portion 582 in the −x direction, and inclines to the −z direction so as to connect the second extending portion 582 and the second-attachment first side surface 532*a*. In addition, the second auxiliary rib portion 592 includes a second horizontal rib 592*b* that is positioned below the second inclined rib 592*a*, and that connects a −x direction end surface downstream of the recess forming portion 51 and the second-attachment first side surface 532*a*.

The operation reception portion 402 having the above-mentioned portions is integrally molded of resin.

Description of Configuration of Rib Portion

Subsequently, the configuration of the rib portion 52 provided on the back surface portion 502 of the operation reception portion 402 illustrated in FIG. 4 will be described.

Figure 5:
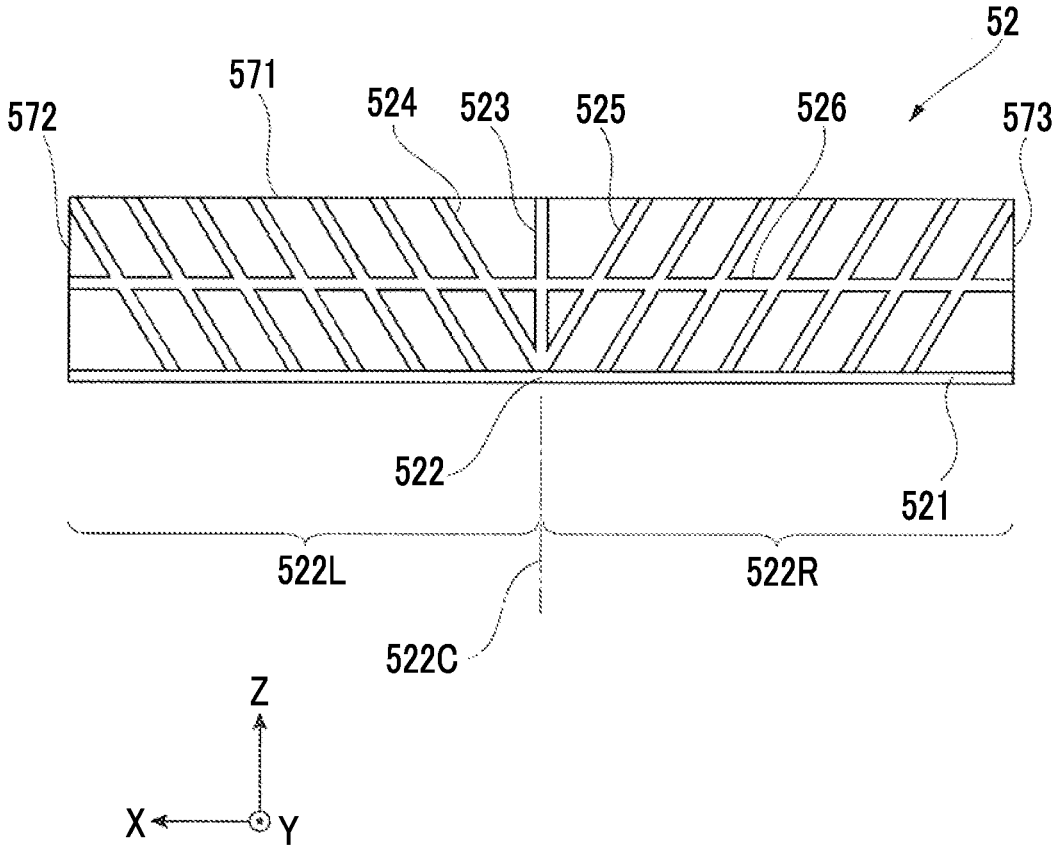
FIG. 5 is a front view illustrating the configuration of a rib portion.

FIG. 5 is a view illustrating the configuration of the rib portion 52 provided on the back surface portion 502 of the base portion 50 of the operation reception portion 402, and a front view of the rib portion 52 when seen from the rear R side. The following configuration is not illustrated in FIG. 5. However, a lower portion of the rib portion 52 is adjacent to the upper end of the opening portion 503 of the back surface portion 502, and a rear R side of the lower end portion of the rib portion 52 is adjacent to the front F side of the other opening portion 511.

The rib portion 52 includes a lower end rib 521 that forms the lower end portion of the rib portion 52, and connects a lower end portion of the first rib end portion 572 and a lower end portion of the second rib end portion 573; and a vertical rib 523 as an example of a ridge portion that connects a reference point portion 522 and the rib upper end portion 571. The reference point portion 522 is an example of a starting point which is provided to a portion of the lower end rib 521 which is adjacent to the center of the upper end of the opening portion 503 of the back surface portion 502, and which the user touches to pull out the accommodating container.

The rib portion 52 includes plural first inclined ribs 524 as an example of plural ridge portions that are provided in one direction, and plural second inclined ribs 525 as an example of plural ridge portions that are provided in the other direction. The first inclined ribs 524 are provided in a left rib portion 522L that lies downstream of a center line 522C in the x direction, and the second inclined ribs 525 are provided in a right rib portion 522R that lies upstream of the center line 522C in the x direction. Here, the center line 522C passes through the reference point portion 522 in the z direction.

The plural first inclined ribs 524 and the plural second inclined ribs 525 extend from the lower end rib 521 in the z direction, and broaden out toward opposite ends in the x direction with the centerline 522C as a center, respectively. The plural first inclined ribs 524 and the plural second inclined ribs 525 are provided in the rib portion 52 in such a manner that extension lines of the first inclined ribs 524 overlap extension lines of the second inclined ribs 525 on the center line 522C at positions lower than the reference point portion 522 in the −z direction, respectively.

The plural first inclined ribs 524 extend from the lower end rib 521 in the z direction, incline to the x direction at the same degree angle, and connect the lower end rib 521 and the rib upper end portion 571. The plural second inclined ribs 525 extend from the lower end rib 521 in the z direction, incline to the −x direction at the same degree angle, and connect the lower end rib 521 and the rib upper end portion 571.

The plural first inclined ribs 524 are disposed with a given gap interposed therebetween in the x direction. The first inclined rib 524, which is one of the plural first inclined ribs 524, and an example of a first ridge portion, is provided from the reference point portion 522 to the rib upper end portion 571. The plural second inclined ribs 525 are disposed with a given gap interposed therebetween in the x direction. The second inclined rib 525, which is one of the plural second inclined ribs 525, and an example of a second ridge portion, is provided from the reference point portion 522 to the rib upper end portion 571.

In addition, the rib portion 52 includes a horizontal rib 526 that connects the first rib end portion 572 and the second rib end portion 573. The horizontal rib 526 extends toward the opposite ends in the x direction from a position between upper and lower ends of the vertical rib 523. The horizontal rib 526 is provided up to the first rib end portion 572 and the second rib end portion 573 while being connected to the plural first inclined ribs 524 and the plural second inclined ribs 525.

Description of Push-In and Pull-Out Operation of Accommodating Container

Subsequently, a user's pull-out and push-in operation of the accommodating container 40 provided in the sheet supply unit 33 of the image forming apparatus 30 will be described with reference to FIGS. 1 to 4.

First, a pull-out operation of the accommodating container 40 in the accommodated state will be described.

With the pads of the fingers facing to the z direction, the user moves the hand from the front F side to the y direction so as to insert the finger tips into the opening portion 503 of the operation reception portion 402 of the accommodating container 40. The finger tips of the user pass through a rear R side of the opening portion 503, and then reach the front F side of the recess forming portion 51. When the finger tips of the user move further to the y direction so as to advance in the opening provided on the front F side of the recess forming portion 51, a surface on a rear R side of the recess forming portion 51 guides the finger tips in the z direction. The finger tips of the user guided by the surface on the rear R side of the recess forming portion 51 advance in the z direction, and reach the other opening portion 511 provided in the upper surface of the recess forming portion 51. Thereafter, the finger tips of the user passing through the other opening portion 511 come into contact with the rib upper end portion 571, and stop advancing in the z direction.

At this time, when the user bends the fingers of the hand put in the operation reception portion 402, the pads of the fingers come into contact with the rib portion 52 while the finger tips of the user support the lower end portion of the rib portion 52.

Here, the center portion in the x direction of the other opening portion 511 overlaps the reference point portion 522 of the lower end rib 521 in the x direction and the z direction, and the center portion is adjacent to the reference point portion 522 in the y direction. For this reason, the finger tips of the user, which pass through the center of the other opening portion 511 in the x direction, and then support the lower end rib 521 of the rib portion 52, are guided to a position at which the reference point portion 522 is centered in the lower end rib 521.

At this time, when the user moves the hand to the −y direction, a load to the −y direction is exerted on a location in which the reference point portion 522 is centered in the lower end rib 521. Accordingly, stress occurs in the operation reception portion 402, and causes the accommodating container 40 to move in the −y direction.

Therefore, the left rail 4013*a* and the right rail, which are respectively provided on the left plate 4013 and the right plate 4014 of the container body portion 401 connected to the operation reception portion 402, smoothly move along the two rail guides provided in the housing 31. As a result, the accommodating container 40 moves to the −y direction with respect to the housing 31. In this manner, the state of the accommodating container 40 transits from the accommodated state to the pull-out state, and the pull-out operation of the accommodating container 40 in the accommodated state is completed.

Subsequently, a push-in operation of the accommodating container 40 in the pull-out state will be described.

When a load to the y direction is exerted on the front surface portion 501 of the operation reception portion 402, thereby causing stress to occur and operate the accommodating container 40 to the y direction, the accommodating container 40 moves to the y direction with respect to the housing 31. In this manner, the state of the accommodating container 40 transits from the pull-out state to the accommodated state, and the push-in operation of the accommodating container 40 in the pull-out state is completed. In the push-in operation, the user may apply a load to any location of the front surface portion 501.

Description of Bending of Operation Reception Portion

As described above, when the user pulls out the accommodating container 40 in the accommodated state, a load to the −y direction is exerted on a portion of the rib portion 52, with which the fingers of the user come into contact, and thus stress occurs in the operation reception portion 402. For this reason, the operation reception portion 402 is bent to the −y direction in conjunction with the fact that the operation reception portion 402 is made of resin.

However, in the exemplary embodiment, since the rib portion 52 is provided with the plural ribs, the accommodating container 40 is prevented from being bent when the user pulls out the accommodating container 40.

Description of Action of Rib Provided in Rib Portion

When stress occurs in the rib portion 52 during a pull-out operation of the accommodating container 40, the action of the ribs provided in the rib portion 52 will be described.

In the exemplary embodiment, one of the first inclined ribs 524 and one of the second inclined ribs 525 are provided from the reference point portion 522 of the lower end rib 521 to the rib upper end portion 571 of the rib portion 52. Accordingly, the stress, which occurs centered about the reference point portion 522 of the lower end rib 521 when the accommodating container 40 is pulled out, is distributed along the first inclined rib 524 and the second inclined rib 525 which are provided from the reference point portion 522. For this reason, the concentration of stress in the reference point portion 522 is relaxed, thereby reducing the amount of bending of the reference point portion 522.

In addition, the plural first inclined ribs 524 and the plural second inclined ribs 525 are provided from the lower end rib 521 to the rib upper end portion 571 of the rib portion 52. Accordingly, the stress occurring in the lower end rib 521 in a state of being centered about the reference point portion 522 is further distributed, thereby reducing the amount of bending of the reference point portion 522.

In addition, the rib portion 52 includes the vertical rib 523 provided from the reference point portion 522 to the rib upper end portion 571. Accordingly, the stress occurring in the reference point portion 522 is distributed in the z direction, thereby reducing the amount of bending of the reference point portion 522.

In addition, the rib portion 52 includes the horizontal rib 526 that extends toward the opposite ends in the x direction from the position between the upper and lower ends of the vertical rib 523, and that is connected to the first rib end portion 572 and the second rib end portion 573. Accordingly, the stress, which occurs at the center of the rib portion 52 in the x direction and in the vicinity of the reference point portion 522, is distributed to the opposite ends in the x direction, thereby reducing the amount of bending of the reference point portion 522.

In addition, in the exemplary embodiment, the back surface portion 502 of the base portion 50 is provided with the first inclined rib 591*a* and the second inclined rib 592*a*. Accordingly, the stress, which occurs in the rib portion 52 and then spreads out from the rib portion 52 to the circumference of the rib portion 52, is distributed in a circumferential direction of the operation reception portion 402, thereby reducing the amount of bending of a portion of the operation reception portion 402, the portion in which stress is concentrated.

In addition, the back surface portion 502 is provided with the first horizontal rib 591*b* and the second horizontal rib 592*b*. Accordingly, the stress spreading out from the rib portion 52 to the circumference of the rib portion 52 is further distributed in the circumferential direction, thereby reducing the amount of bending of the portion of the operation reception portion 402, the portion in which stress is concentrated.

In the exemplary embodiment, the plural first inclined ribs 524 are disposed with a given gap interposed therebetween in the x direction. However, insofar as the plural first inclined ribs 524 separate from each other in the x direction, the first inclined ribs 524 may have different gaps in the x direction.

The plural second inclined ribs 525 are disposed with a given gap interposed therebetween in the x direction. However, insofar as the plural second inclined ribs 525 separate from each other in the x direction, the second inclined ribs 525 may have different gaps in the x direction.

The plural first inclined ribs 524 incline to the x direction at the same degree angle, but may have a different degree of the x direction inclination. The plural second inclined ribs 525 incline to the −x direction at the same degree angle, but may have a different degree of the −x direction inclination.

In the exemplary embodiment, the rib portion 52 is provided with the plural first inclined ribs 524 and the plural second inclined ribs 525, but may be provided with only one of the first inclined rib 524 and only one of the second inclined rib 525. When the rib portion 52 is provided with only one of the first inclined ribs 524 and only one of the second inclined ribs 525, it is most preferable that the first inclined rib 524 and the second inclined rib 525 be provided from the reference point portion 522 of the lower end rib 521 to the rib upper end portion 571.

In the exemplary embodiment, the rib portion 52 is provided with the vertical rib 523. However, when the rib portion 52 is provided with one or more of the first inclined ribs 524 and one or more of the second inclined ribs 525, the rib portion 52 may not be provided with the vertical rib 523.

In the exemplary embodiment, the rib portion 52 is provided with the horizontal rib 526. However, when the rib portion 52 is provided with one or more of the first inclined ribs 524 and one or more of the second inclined ribs 525, the rib portion 52 may not be provided with the horizontal rib 526.

In the exemplary embodiment, the back surface portion 502 is provided with the first inclined rib 591*a* and the second inclined rib 592*a*. However, when the rib portion 52 is provided with one or more of the first inclined ribs 524 and one or more of the second inclined ribs 525, the rib portion 52 may not be provided with the first inclined rib 591*a* and the second inclined rib 592*a*.

In the exemplary embodiment, the back surface portion 502 is provided with the first horizontal rib 591*b* and the second horizontal rib 592*b*. However, when the rib portion 52 is provided with one or more of the first inclined ribs 524 and one or more of the second inclined ribs 525, the rib portion 52 may not be provided with the first horizontal rib 591*b* and the second horizontal rib 592*b*.

Description of Modification Example of Rib Provided in Rib Portion

In the exemplary embodiment, the plural ribs are provided in the rib portion 52 of the back surface portion 502 of the base portion 50 of the operation reception portion 402, and thus the accommodating container 40 is prevented from being bent when the user pulls out the accommodating container 40. Here, the ribs provided in the rib portion 52 are not limited to the configuration illustrated in FIG. 5.

Hereinafter, the configuration of the rib portion 52 provided with the ribs different from those illustrated in FIG. 5 will be described. The same reference numbers are assigned to the same configuration members as those in FIG. 5, and the descriptions thereof will be omitted.

Figure 6:
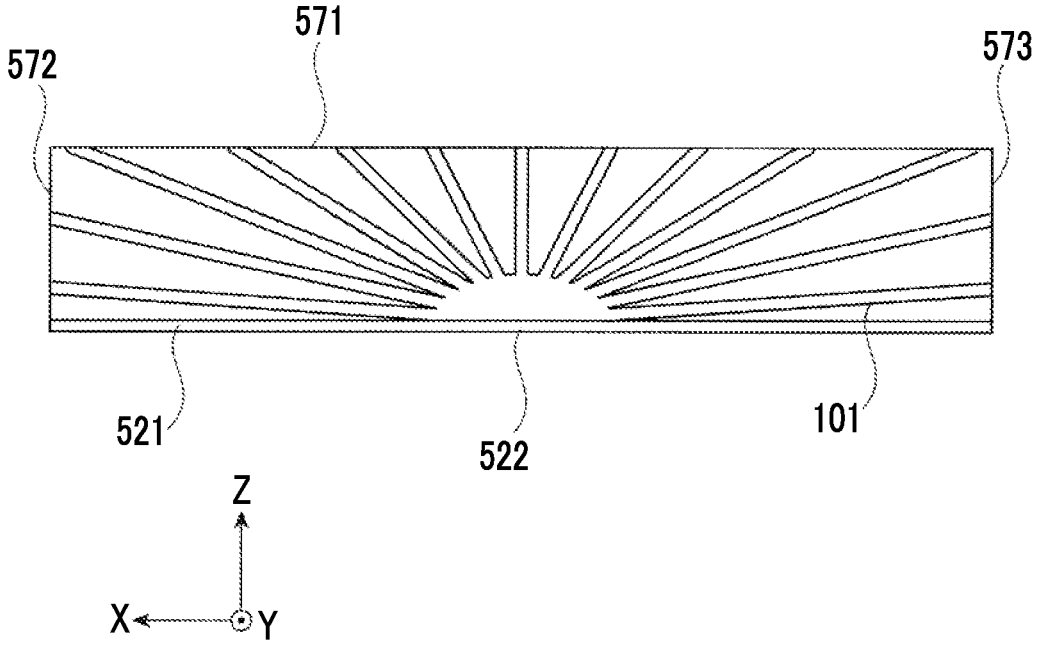
FIG. 6 is a front view illustrating the configuration of the rib portion as a modification example.

FIG. 6 is a view illustrating the configuration of the rib portion 52 provided in the back surface portion 502 of the base portion 50 of the operation reception portion 402, as a modification example of the ribs provided in the rib portion 52, and is a front view of the rib portion 52 when seen from the rear R side.

The rib portion 52 includes plural radial ribs 101 as an example of plural ridge portions that extend radially from the reference point portion 522, and are connected to the reference point portion 522 and any one of the first rib end portion 572, the rib upper end portion 571, and the second rib end portion 573.

Since the rib portion 52 is provided with the ribs in this manner, stress, which occurs centered about the reference point portion 522 of the lower end rib 521, is distributed along the plural radial ribs 101 that are provided to spread out from the reference point portion 522. For this reason, the concentration of stress in the reference point portion 522 of the lower end rib 521 is relaxed, thereby reducing the amount of bending of the reference point portion 522.

As such, it is preferable that the plural ribs provided in the rib portion 52 be provided in the lower end rib 521, and extend from the lower end rib 521 in such a manner that the ribs spread out from the reference point portion 522 of the lower end rib 521. That is, plural ribs, which are provided in the vicinity of a center portion that receives the stress occurring when the accommodating container 40 is pulled out, extend in such a manner that the ribs spread out from the center portion of the occurring stress, thereby causing the occurring stress to be distributed, and reducing the amount of bending of the center portion that receives the occurring stress. In the exemplary embodiment, the reference point portion 522 of the lower end rib 521 of the rib portion 52 is the center portion that receives the stress occurring when the accommodating container 40 is pulled out.

The plural radial ribs 101 may be preferably provided at least from the reference point portion 522 to any one of a portion of the rib upper end portion 571, the portion lying on a right side of a center portion of the rib upper end portion 571 in the x direction, and the first rib end portion 572. The plural radial ribs 101 may be preferably provided at least from the reference point portion 522 to any one of a portion of the rib upper end portion 571, the portion lying on a left side of the center portion of the rib upper end portion 571 in the x direction, and the second rib end portion 573.

Description of Modification Example of Operation Reception Portion

In the exemplary embodiment, the case in which the user inserts the finger tips into the base portion 50 provided in the operation reception portion 402 of the accommodating container 40 is described as an example. The shape of the operation reception portion 402 is not limited to that in the exemplary embodiment.

Figure 11A:
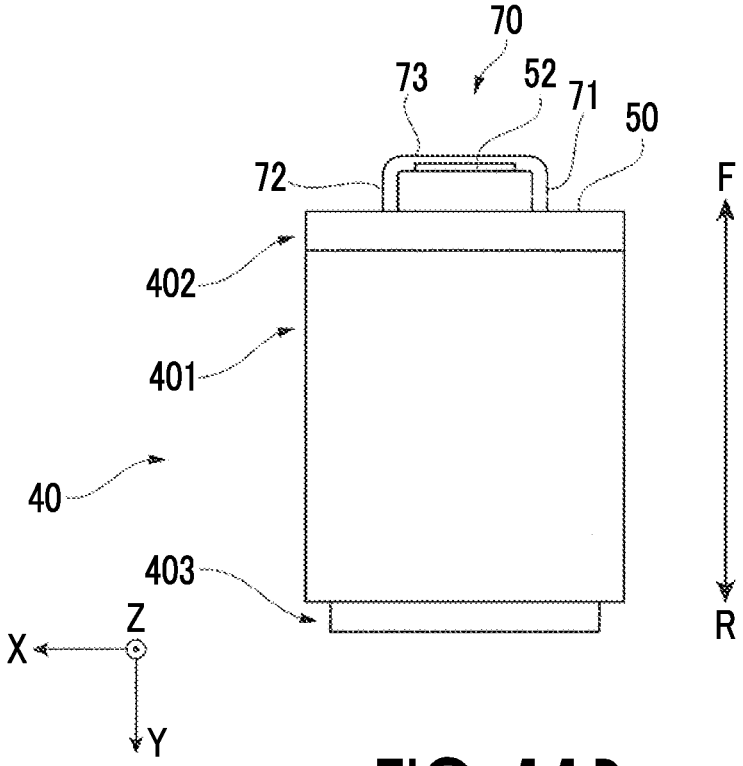
FIGS. 11A and 11B are views illustrating the configuration of the operation reception portions as a modification example and another modification example, respectively.

FIG. 11A is a view illustrating a modification example of the operation reception portion 402 attached to the container body portion 401 of the accommodating container 40, and a top view of the accommodating container 40. Here, the same reference numbers are assigned to the same configuration members as those in FIGS. 3 and 4, and the descriptions thereof will be omitted.

The operation reception portion 402 of the accommodating container 40 illustrated in FIG. 11A includes the base portion 50, and a grasp portion 70 that is provided to protrude from a front F side of the base portion 50 and that the user grasps when pulling out the accommodating container 40 provided in the sheet supply unit 33 of the image forming apparatus 30.

The grasp portion 70 includes a first protruding portion 71 and a second protruding portion 72 which protrude from the front F side of the base portion 50. The grasp portion 70 includes a connecting portion 73 that connects the first protruding portion 71 and the second protruding portion 72. The rib portion 52 is provided on a rear R side of the connecting portion 73, and is a portion with which the finger tips of the user come into contact when the user pulls out the accommodating container 40.

Figure 11B:
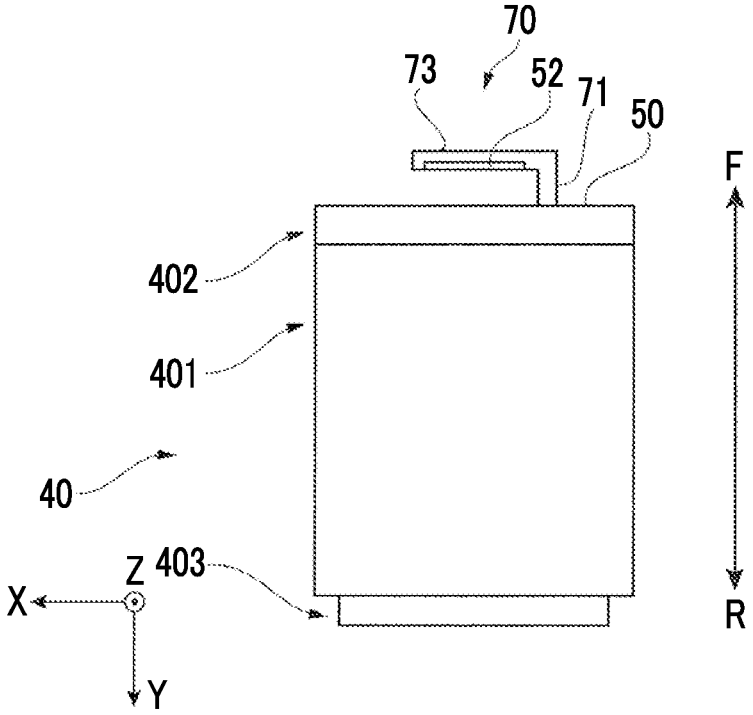

FIG. 11B is a view illustrating another modification example of the operation reception portion 402 attached to the container body portion 401 of the accommodating container 40, and a top view of the accommodating container 40. The same reference numbers are assigned to the same configuration members as those in FIG. 11A, and the descriptions thereof will be omitted.

The grasp portion 70 illustrated in FIG. 11B includes the first protruding portion 71 that protrudes from the front F side of the base portion 50, and the connecting portion 73 that is connected to the first protruding portion 71. The grasp portion 70 illustrated in FIG. 11B is different from the grasp portion 70 illustrated in FIG. 11A in that the connecting portion 73 is connected to only the first protruding portion 71, and the second protruding portion 72 is not provided. The grasp portion 70 illustrated in FIG. 11B is the same as the grasp portion 70 illustrated in FIG. 11A in that the rib portion 52 is provided on the rear R side of the connecting portion 73.

As such, the portion of the rib portion 52, which the user touches when pulling out the accommodating container 40, may be provided to protrude from the front F side of the base portion 50 of the operation reception portion 402. The rib portion 52 of the operation reception portion 402 illustrated in FIGS. 11A and 11B may adopt any one of the respective configurations of the rib portions 52 illustrated in FIGS. 5 and 6.

Example

Hereinafter, an example of the present invention will be described, but the present invention is not limited to the example.

The inventor of the present invention manufactured the operation reception portion 402 in which the back surface portion 502 of the base portion 50 is provided with the rib portion 52 illustrated in FIG. 5. In a load test performed on the manufactured operation reception portion 402, a given load is exerted on the entirety of the rib portion 52. The following is evaluated: a location of the occurrence of the maximum amount of bending, and the maximum amount of bending occurring in the operation reception portion 402.

Figure 7A:
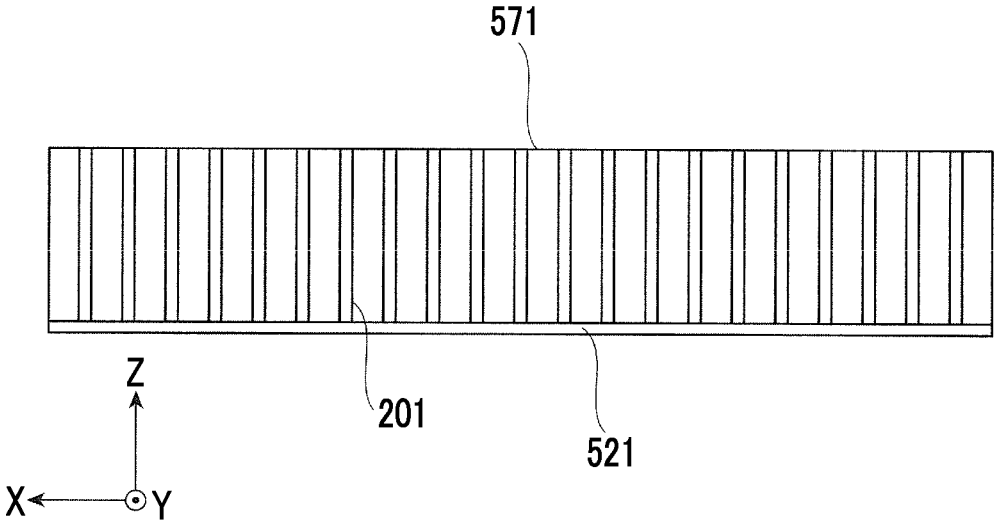
FIGS. 7A and 7B are front views illustrating the configuration of the rib portions as Comparative Example 1 and Comparative Example 2, respectively.
Figure 7B:
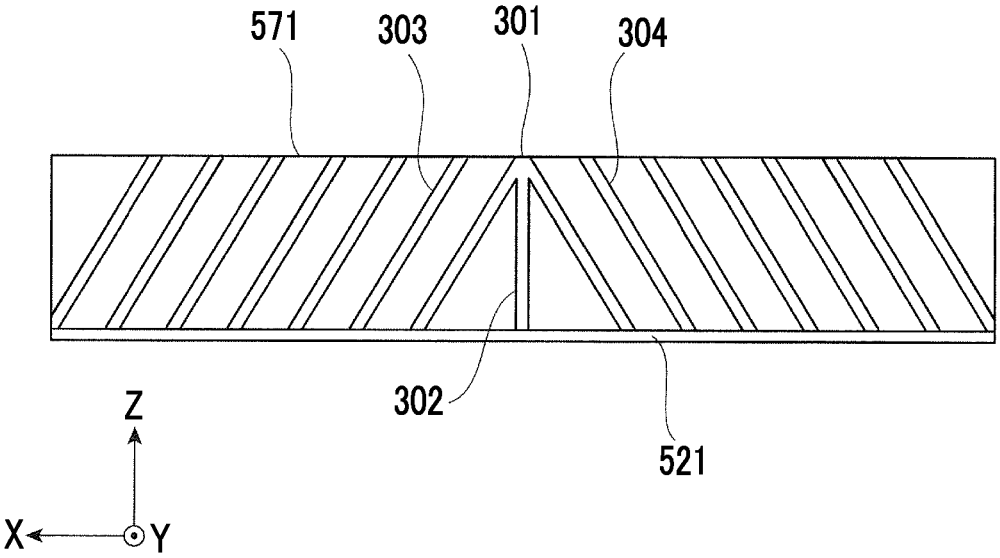

Here, FIGS. 7A and 7B illustrate comparative examples which are comparative objects for the example described above. The configuration of the rib portion 52 which is provided with the ribs different from those in the exemplary embodiment will be described. The same reference signs will be assigned to the same configuration members as those in the exemplary embodiment, and the descriptions thereof will be omitted.

In Comparative Example 1, FIG. 7A illustrates the configuration of the rib portion 52 provided with the ribs in the back surface portion 502 of the base portion 50 of the operation reception portion 402.

The rib portion 52 includes plural vertical ribs 201 that connect the lower end rib 521 and the rib upper end portion 571. The plural vertical ribs 201 are provided with a given gap interposed therebetween in the x direction.

Here, the rib portion 52 in Comparative Example 1 is different from the rib portion 52 in the example in that the rib portion 52 includes the ribs provided from the lower end rib 521 to the rib upper end portion 571, but do not incline to the x direction or the −x direction.

In Comparative Example 2, FIG. 7B illustrates the configuration of the rib portion 52 provided with the ribs in the back surface portion 502 of the base portion 50 of the operation reception portion 402.

The rib portion 52 includes a vertical rib 302 that connects another reference point portion 301, which is the center portion of the rib upper end portion 571 in the x direction, and the lower end rib 521. The rib portion 52 includes plural first inclined ribs 303 and plural second inclined ribs 304. The first inclined ribs 303 extend to the −z direction from the rib upper end portion 571, and incline to the x direction at the same degree angle so as to connect the rib upper end portion 571 and the lower end rib 521. The second inclined ribs 304 extend to the −z direction from the rib upper end portion 571, and incline to the −x direction at the same degree angle so as to connect the rib upper end portion 571 and the lower end rib 521.

The plural first inclined ribs 303 are disposed with a given gap interposed therebetween in the x direction. One of the plural first inclined ribs 303 is provided from the other reference point portion 301 of the rib upper end portion 571 to the lower end rib 521.

The plural second inclined ribs 304 are disposed with a given gap interposed therebetween in the x direction. One of the plural second inclined ribs 304 is provided from the other reference point portion 301 of the rib upper end portion 571 to the lower end rib 521.

Here, in the rib portion 52 of Comparative Example 2, the plural first inclined ribs 303 and the plural second inclined ribs 304 are provided to extend from the lower end rib 521 to the rib upper end portion 571 in such a manner that the first inclined ribs 303 and the second inclined ribs 304 converge toward the other reference point portion 301 of the rib upper end portion 571 which lies above the lower end rib 521. In this regard, the rib portion 52 in Comparative Example 2 is different from the rib portion 52 in the example in which the plural first inclined ribs 524 and the plural second inclined ribs 525 are provided to extend from the lower end rib 521 to the rib upper end portion 571 in such a manner that the first inclined ribs 524 and the second inclined ribs 525 spread out from the reference point portion 522 of the lower end rib 521.

In any one of the example, Comparative Example 1, and Comparative Example 2, the operation reception portion 402 is made of resin that had a tensile modulus (Young's modulus) of 2400 N/mm$^2$. A load test is performed in such a manner that a load of 30 N is exerted from the rear R side on the entirety of the rib portion 52 of the back surface portion 502 of the base portion 50 of the operation reception portion 402.

Figure 8:
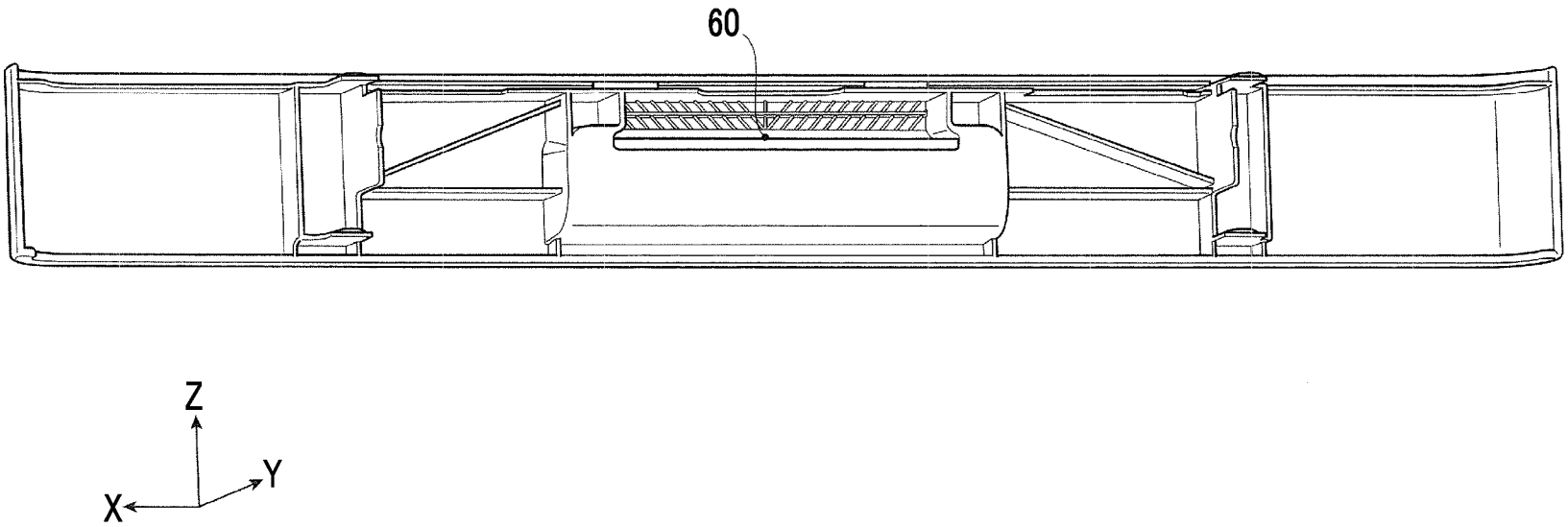
FIG. 8 is a view illustrating a location in which the maximum amount of bending occurs in the operation reception portion when a load test is performed on the operation reception portion provided with the rib portion illustrated in FIG. 5.

FIG. 8 is a view illustrating a location in which the maximum amount of bending occurs in the operation reception portion 402 when a load test is performed on the operation reception portion 402 provided with the rib portion 52 in the example.

A maximum bending occurring portion 60 refers to a portion in which the maximum amount of bending occurs in the operation reception portion 402 when the load test is performed. The maximum bending occurring portion 60 is in the reference point portion 522 of the lower end rib 521 of the rib portion 52. Bending of 0.66 mm occurred in the maximum bending occurring portion 60 due to the load test.

Figure 9:
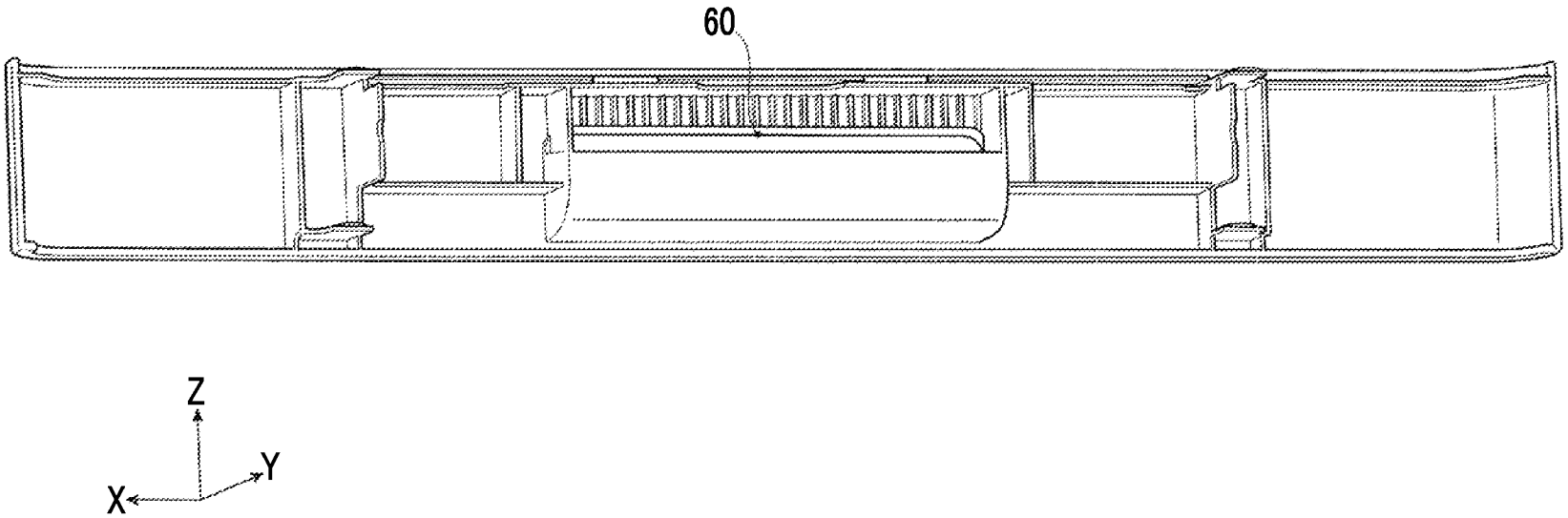
FIG. 9 is a view illustrating a location in which the maximum amount of bending occurs in the operation reception portion when a load test is performed on the operation reception portion provided with the rib portion illustrated in FIG. 7A.

FIG. 9 is a view illustrating a location in which the maximum amount of bending occurs in the operation reception portion 402 when a load test is performed on the operation reception portion 402 provided with the rib portion 52 in Comparative Example 1.

When the load test is performed, the maximum bending occurring portion 60 is in the reference point portion 522 of the lower end rib 521 of the rib portion 52. Bending of 1.22 mm occurred in the maximum bending occurring portion 60 due to the load test.

Figure 10:
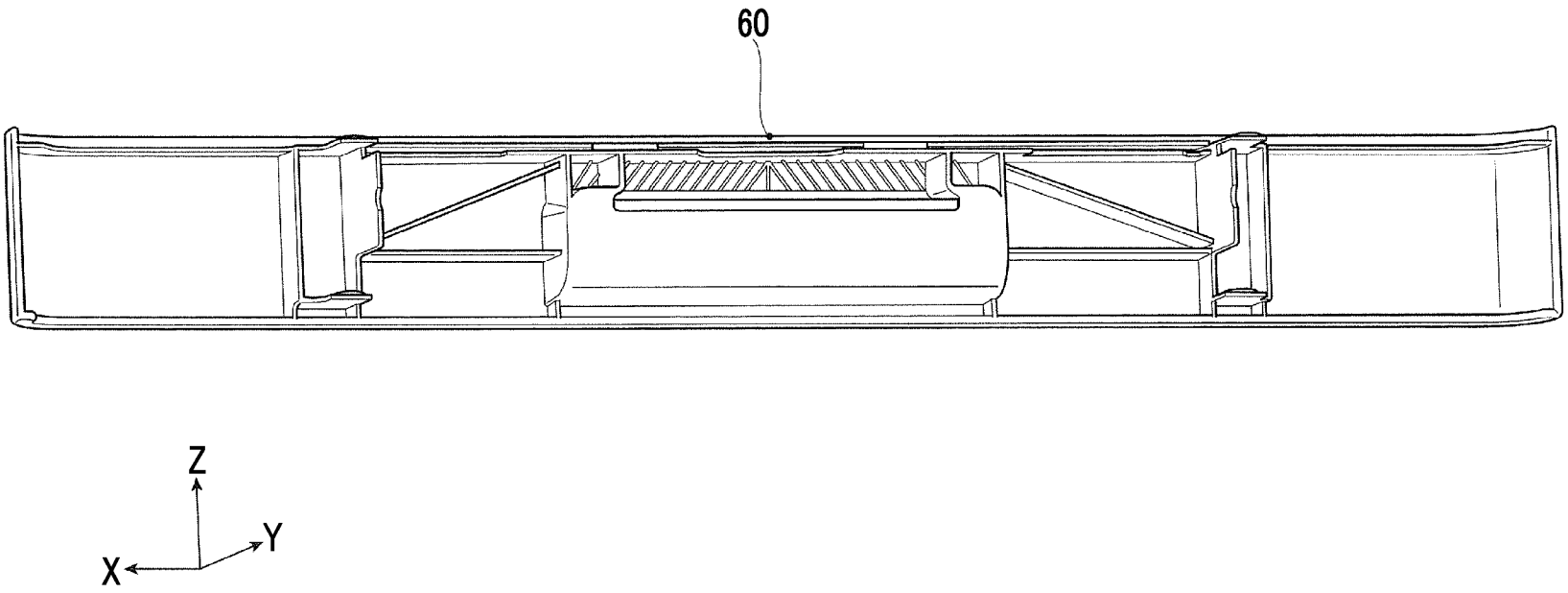
FIG. 10 is a view illustrating a location in which the maximum amount of bending occurs in the operation reception portion when a load test is performed on the operation reception portion provided with the rib portion illustrated in FIG. 7B.

FIG. 10 is a view illustrating a location in which the maximum amount of bending occurs in the operation reception portion 402 when a load test is performed on the operation reception portion 402 provided with the rib portion 52 in Comparative Example 2.

When the load test is performed, the maximum bending occurring portion 60 is above the reference point portion 301 and in a center portion in the x direction of an upper end of the back surface portion 502 of the base portion 50 of the operation reception portion 402. Bending of 2.57 mm occurred in the maximum bending occurring portion 60 due to the load test.

When the load tests are performed on the operation reception portions 402 provided with respective rib portions 52 in the example, Comparative Example 1, and Comparative Example 2, the test result is that the maximum amount of bending of the operation reception portion 402 provided with the rib portion 52 in the example is the smallest value.

The rib portion 52 in the example includes only one of the first inclined rib 524 and only one of the second inclined rib 525 provided from the reference point portion 522 to the rib upper end portion 571. Accordingly, when the accommodating container 40 is pulled out, and stress occurred in the rib portion 52 in a state of being centered about the reference point portion 522 of the lower end rib 521, the concentration of stress in the reference point portion 522 is relaxed, thereby reducing the amount of bending of the reference point portion 522 of the operation reception portion 402.

When the load test is performed on the operation reception portion 402 provided with the rib portion 52 in Comparative Example 1, the maximum bending occurring portion is in the reference point portion 522 similar to the operation reception portion 402 provided with the rib portion 52 in the example. However, when the load test is performed on the operation reception portion 402 provided with the rib portion 52 in Comparative Example 1, the test result is that the operation reception portion 402 had the maximum amount of bending greater than that of the operation reception portion 402 provided with the rib portion 52 in the example.

This is because when the accommodating container 40 is pulled out, the stress occurring centered about the reference point portion 522 of the lower end rib 521 is less distributed by the plural vertical ribs 201 connecting the lower end rib 521 and the rib upper end portion 571, compared to the stress occurring in the reference point portion 522 of the operation reception portion 402 provided with the rib portion 52 in the example.

When the load test is performed, the maximum bending occurring portion 60 of the operation reception portion 402 provided with the rib portion 52 in Comparative Example 2 is positioned at a location different from that of the operation reception portion 402 provided with the rib portion 52 in each of the example and Comparative Example 1. The maximum amount of bending occurring in the operation reception portion 402 in Comparative Example 2 due to the load test is greater than that of the operation reception portion 402 provided with the rib portion 52 in each of the example and Comparative Example 1. This is because when the accommodating container 40 is pulled out, the stress occurring centered about the reference point portion 522 of the lower end rib 521 propagated toward an upper portion of the rib portion 52 along the vertical rib 302, the first inclined ribs 303, and the second inclined ribs 304 which connect the lower end rib 521 and the rib upper end portion 571, and concentrated in a center portion in the x direction of the back surface portion 502.

As described above, in the accommodating container 40 of the exemplary embodiment, the back surface portion 502 of the operation reception portion 402 is provided with the rib portion 52 in which the first inclined ribs 524 and the second inclined ribs 525 are formed from the reference point portion 522 of the lower end rib 521 to the rib upper end portion 571. Accordingly, when the accommodating container 40 is pulled out by the user, the accommodating container 40 is prevented from being bent. Also with the operation reception portion 402 provided with the rib portion 52 illustrated in FIG. 6 as the modification example, the same load test result is obtained as that of the operation reception portion 402 provided with the rib portion 52 illustrated in FIG. 5 in the example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An accommodating container that is mounted in a housing, accommodates an accommodated object therein, and is provided in such a manner that the accommodating container is capable to be pulled out of the housing, the accommodating container comprising:

an operation reception portion that is provided with a starting point in a portion thereof which a user touches when pulling the accommodating container out of the housing, and a plurality of ridge portions which extend in different directions from the starting point, wherein the accommodating container is configured for operation with an image forming apparatus, and wherein the plurality of ridge portions are located on an upper end of an opening portion of a recess forming portion, the recess forming portion protruding from a back surface portion of a base portion of the accommodating container, wherein the plurality of ridge portions are located at an underside of the operation reception portion, and wherein the accommodating container includes inclined ribs on the back surface portion of the base portion, and first and second horizontal ribs on the back surface portion.

2. The accommodating container according to claim 1, wherein each of the plurality of ridge portions provided in the operation reception portion includes:

a first ridge portion extending in a first direction; and a second ridge portion extending in a second direction which is different from the first direction, and wherein the operation reception portion further includes:

a third ridge portion that is adjacent to the first ridge portion and extends in the first direction; and a fourth ridge portion that is adjacent to the second ridge portion and extends in the second direction.

3. The accommodating container according to claim 2, wherein the operation reception portion includes three or more of the ridge portions that are radially formed from the starting point.

4. The accommodating container according to claim 1, wherein the operation reception portion includes three or more of the ridge portions that are radially formed from the starting point.

5. An accommodating container that is mounted in a housing, accommodates an accommodated object therein, and is provided in such a manner that the accommodating container is capable to be pulled out of the housing, the accommodating container comprising: an operation reception portion that includes a plurality of ridge portions, wherein the plurality of ridge portions include:

a plurality of ridge portions provided in one direction in which the ridge portions broaden out toward one side of a borderline that passes through a portion of the operation reception portion which a user touches when pulling the accommodating container out of the housing; and a plurality of ridge portions provided in the other direction in which the ridge portions broaden out toward the other side of the borderline, wherein the accommodating container is configured for operation an image forming apparatus, and wherein the plurality of ridge portions are located on an upper end of an opening portion of a recess forming portion, the recess forming portion protruding from a back surface portion of a base portion of the accommodating container, wherein the plurality of ridge portions are located at an underside of the operation reception portion, and wherein the accommodating container includes inclined ribs on the back surface portion of the base portion, and first and second horizontal ribs on the back surface portion.

6. A recording material supply apparatus comprising:

an accommodating container that accommodates a recording material;

a supply unit that supplies the recording material accommodated in the accommodating container to the outside; and a housing in which the accommodating container is mounted, and supports the accommodating container in such a manner that the accommodating container is capable to be pulled out, wherein the accommodating container includes:

an operation reception portion that is provided with a starting point in a portion thereof which a user touches when pulling the accommodating container out of the housing; and a plurality of ridge portions which extend in different directions from the starting point, wherein the accommodating container is configured for operation with an image forming apparatus, wherein the plurality of ridge portions are located on an upper end of an opening portion of a recess forming portion, the recess forming portion protruding from a back surface portion of a base portion of the accommodating container, wherein the plurality of ridge portions are located at an underside of the operation reception portion, and wherein the accommodating container includes inclined ribs on the back surface portion of the base portion, and first and second horizontal ribs on the back surface portion.

* * * * *